US010405715B2

(12) United States Patent
Walker

(10) Patent No.: US 10,405,715 B2
(45) Date of Patent: Sep. 10, 2019

(54) CLEANING DEVICE

(71) Applicant: BLACK & DECKER INC., New Britain, CT (US)

(72) Inventor: Andrew Walker, Durham (GB)

(73) Assignee: Black & Decker, Inc., New Britain, CT (US)

( * ) Notice: Subject to any disclaimer, the term of this patent is extended or adjusted under 35 U.S.C. 154(b) by 126 days.

(21) Appl. No.: 15/805,920

(22) Filed: Nov. 7, 2017

(65) Prior Publication Data

US 2018/0132688 A1 May 17, 2018

(30) Foreign Application Priority Data

Nov. 16, 2016 (EP) ..... 16199161

(51) Int. Cl.

| | |
|---|---|
| ***A47L 9/14*** | (2006.01) |
| ***A47L 5/24*** | (2006.01) |
| ***A47L 9/28*** | (2006.01) |
| ***A47L 9/12*** | (2006.01) |
| ***A47L 9/32*** | (2006.01) |
| ***A47L 7/00*** | (2006.01) |
| ***A47L 9/00*** | (2006.01) |

(52) U.S. Cl.

CPC ..... *A47L 9/149* (2013.01); *A47L 5/24* (2013.01); *A47L 7/0019* (2013.01); *A47L 9/0081* (2013.01); *A47L 9/12* (2013.01); *A47L 9/2857* (2013.01); *A47L 9/322* (2013.01)

(58) Field of Classification Search

CPC ..... A47L 9/149; A47L 5/24; A47L 7/0019; A47L 9/0081; A47L 9/12; A47L 9/2857; A47L 9/322

See application file for complete search history.

(56) References Cited

U.S. PATENT DOCUMENTS 4,011,624 A * 3/1977 Proett ..... A47L 5/24 15/344
4,209,875 A * 7/1980 Pugh ..... A47L 5/24 15/344

(Continued)

FOREIGN PATENT DOCUMENTS

EP 0008117 2/1980
EP 1491126 12/2004

(Continued)

OTHER PUBLICATIONS

EP Search Report dated May 12, 2017 relating to EP Application No. 16199161.7.

*Primary Examiner* — Dung Van Nguyen
(74) *Attorney, Agent, or Firm* — John Yun

(57) ABSTRACT

A vacuum cleaner comprises a housing and a motor fan assembly arranged to generate an air flow. A detachable dirt container is mountable to the housing; the dirt container having a dirty air inlet in fluid communication with the motor fan assembly. A filter is for separating dirt from the air flow, the filter being mounted between the dirt container and the motor fan assembly. The housing comprises at least one air outlet for exhausting clean air from the motor fan assembly. Wherein the detachable dirt container comprises at least one projecting lip arranged to overlap the at least one air outlet when the detachable dirt container is mounted on the housing and direct the air flow away from the dirty air inlet.

15 Claims, 6 Drawing Sheets

(56) References Cited

U.S. PATENT DOCUMENTS

| | | | | |
|---|---|---|---|---|
| 4,536,914 | A | 8/1985 | Levine | |
| 4,831,685 | A | 5/1989 | Bosyj et al. | |
| 5,970,572 | A * | 10/1999 | Thomas | A47L 5/24 15/320 |
| 6,493,903 | B1 * | 12/2002 | Super | A47L 5/24 15/324 |

FOREIGN PATENT DOCUMENTS

| | | |
|---|---|---|
| WO | WO02067753 | 9/2002 |
| WO | WO2010048305 | 4/2010 |

* cited by examiner

CLEANING DEVICE

CROSS-REFERENCE TO RELATED APPLICATION

This application claims priority to European Patent Application No. 16199161.7 filed Nov. 16, 2016. The entire contents of that application are expressly incorporated herein by reference.

FIELD OF THE INVENTION

The present invention relates to a vacuum cleaner.

BACKGROUND OF THE INVENTION

Many people use vacuum cleaners to clean and tidy their homes. Normally vacuum cleaners are used to pick up dust and debris using a negative pressure. Dust and debris is entrained in an air flow and sucked into the body of the vacuum cleaner wherein the dust and debris are separated from the air flow. Once separated from the air flow, the dust and debris are collected and usually emptied in a dustbin at the user's convenience.

Some vacuum cleaners have complicated mechanisms for emptying the dirt container. For example EP 1 377 197 discloses a trigger mechanically coupled to a rod and latch release mechanism for a lid of the dust container. The user may not understand how to release the lid of the dust container and may damage the latch mechanism by attempting to prise the lid open.

Another vacuum cleaner is shown in U.S. Pat. No. 4,536,914 which has a storage chamber for receiving dirt and a filter mounted between the chamber and the rest of the vacuum cleaner. In order to empty the storage chamber, the user must touch the dirty filter and thereby getting their hands soiled when emptying the dust container. Furthermore the exhaust vents of the vacuum cleaner are located on the underside of the housing. This means that the exhaust clean air can be directed forwards towards the nozzle and the dirt and debris can be blown away from the nozzle. This is undesirable because the vacuum cleaner itself can end up distributing the dirt and debris further afield.

Embodiments described hereinafter aim to address the aforementioned problems.

SUMMARY OF THE INVENTION

According to an aspect of the present invention there is a vacuum cleaner comprising: a housing; a motor fan assembly arranged to generate an air flow;

a detachable dirt container mountable to the housing; the dirt container having a dirty air inlet in fluid communication with the motor fan assembly; a filter for separating dirt from the air flow, the filter being mounted between the dirt container and the motor fan assembly; and the housing comprises at least one air outlet for exhausting clean air from the motor fan assembly; wherein the detachable dirt container comprises at least one projecting lip arranged to overlap the at least one air outlet when the detachable dirt container is mounted on the housing and direct the air flow away from the dirty air inlet.

This means that the vacuum cleaner has a simple construction and the vacuum cleaner is easy to empty. Furthermore the construction of air outlets is simpler and less parts and material is needed for the vacuum cleaner.

Preferably the at least one air outlet is a first air outlet on a first side of the housing and a second air outlet on a second side of the housing. This means that the exhaust air is directed away from the nozzle along the sides of the vacuum cleaner. Accordingly the exhaust is less likely to blow the dust away from the dirty air inlet.

Preferably the housing and the at least one projecting lip are arranged to define at least one air exhaust conduit when the detachable dirt container is mounted on the housing. This makes the construction of the vacuum cleaner simpler because the existing parts of the dirt container and the housing define the exhaust air conduit.

Preferably the air flow is directed along the surface of the housing in a direction opposite to the dirty air inlet. Accordingly the exhaust is less likely to blow the dust away from the dirty air inlet.

Preferably the at least one projecting lip comprises a first projecting lip and a second projecting lip arranged to respectively extend substantially along the first and second sides of the housing. Preferably the projecting lips extend rearwards beyond the fan when the dirt container is mounted on the housing.

Preferably a portion of the housing adjacent to the air outlets is engageable with the detachable dirt container. This forms a baffle and guides the air flow away from the dirt air inlet.

Preferably wherein the vacuum cleaner comprises a releasable latch mechanism for selectively releasing the dirt container from the housing. Preferably the latch mechanism comprises a first portion of the latch mechanism on the housing and a second reciprocal portion of the latch mechanism on the dirt container. Preferably the latch mechanism comprises a latch release button mounted in the housing for actuating the latch mechanism. Preferably the latch release button is mounted in the first handle and actuatable with a user's thumb. This means that the user is less likely to accidently detach the dirt container from the housing.

Preferably the filter is removable from the dirt container. Preferably the filter is mountable on the dirt container and extends across a side of the dirt container opposite to the dirty air inlet. Preferably filter is a wall of the dirt container. Since the filter is removable it is replaceable and can be easily cleaned and maintained. The filter forms a wall of the dirt container and this makes a more compact vacuum cleaner requiring less parts and materials.

Preferably the vacuum cleaner is a handheld vacuum cleaner.

BRIEF DESCRIPTION OF THE DRAWINGS

Various other aspects and further embodiments are also described in the following detailed description and in the attached claims with reference to the accompanying drawings, in which:

DETAILED DESCRIPTION OF INVENTION

Figure 1:
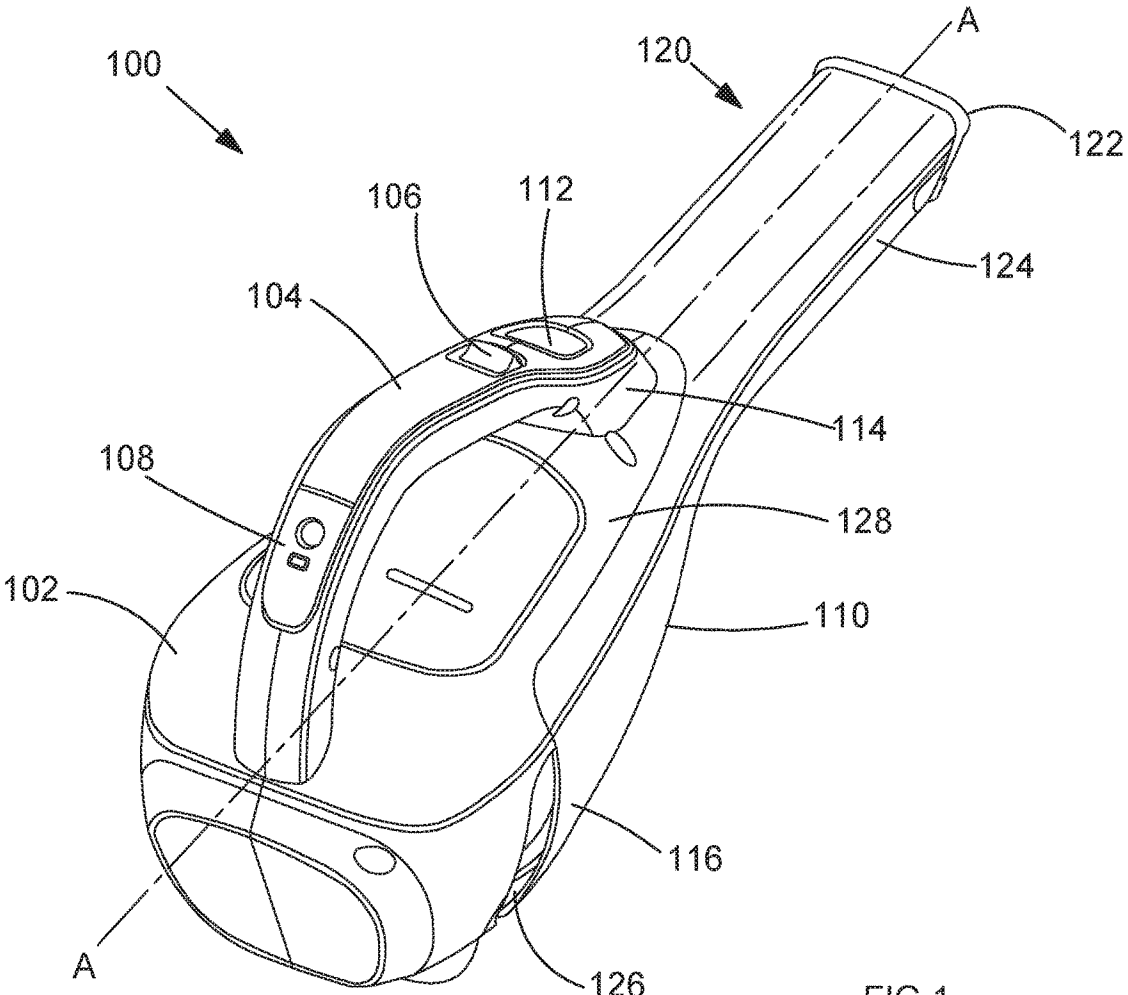
FIG. 1 shows a perspective view of a vacuum cleaner.

FIG. 1 shows a perspective view of vacuum cleaner 100. The vacuum cleaner 100 as shown in FIG. 1 is a handheld vacuum cleaner, but the in other embodiments the vacuum cleaner 100 may be an upright vacuum cleaner, a stickvac, a canister vacuum cleaner or any other type of vacuum cleaner. References to vacuum cleaner 100 hereinafter will be in reference to the handheld vacuum cleaner as shown in the Figures.

Vacuum cleaner 100 has a housing 102 which comprises two clam-shell halves fixed together. A motor-fan assembly (reference 500 in FIG. 5) is housed within the housing 102. The motor fan assembly 500 is arranged to create a negative pressure for creating an airflow for sucking up dirt and debris.

The housing 102 comprises a first handle 104. The first handle 104 is integral with the housing 102 and the user grips the first handle when operating the vacuum cleaner 100. The handle comprises an ON/OFF switch 106 for operating the vacuum cleaner. In some embodiments the handle comprises indicators for providing information about the vacuum cleaner 100 to the user. A battery indicator 108 is mounted on the handle for indicating to the user the charge level status of the battery. Further indicators (not shown) such as filter status indicators (filter blocked/filter cleared) can be mounted on the handle or elsewhere on the housing.

A detachable dirt container 110 is mounted to the housing 102. The detachable dirt container 110 is coupled to the housing 102 via a latch mechanism 302 which will be discussed in further detail in respect of FIG. 3. The latch mechanism 302 is actuated with a latch release button 112. The latch release button 112 is mounted in the first handle 104. The latch release button 112 is mounted on a forward portion 114 of the first handle 104. This means that the user is able to actuate the latch mechanism with their thumb when they are gripping the first handle 104.

Figure 2:
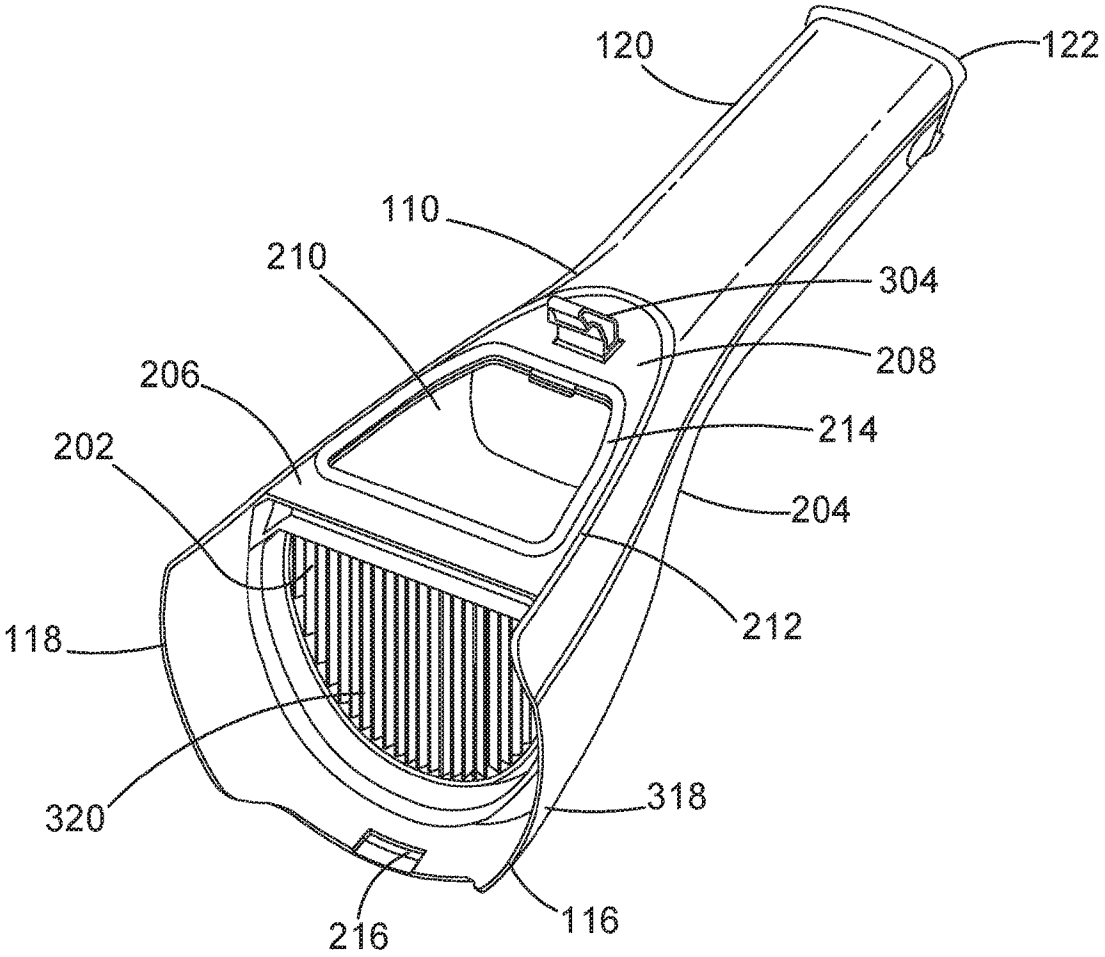
FIG. 2 shows partial perspective view of the vacuum cleaner.

The detachable dirt container 110 comprises a first projecting lip 116 and a second projecting lip 118. The first and second projecting lips 116, 118 are located at the sides of the vacuum cleaner 100. The first and second projecting side lips are arranged to envelope a portion of the housing 102. The first and second projecting side lips 116, 118 can be seen in FIG. 2. FIG. 2 shows a perspective view of the detachable dirt container 110. When the detachable dirt container 110 is mounted on the housing, the detachable dirt container is flush with the surface of the housing 102.

Turning back to FIG. 1, the detachable dirt container 110 comprises a nozzle 120 having a dirty air inlet 122. The nozzle 120 is hollow and comprises a conduit such that the dirty air inlet 122 is in fluid communication with the dirt container 110. The nozzle 120 is integral with the detachable dirt container 110 and projects forwardly away from the housing 102. In some embodiments the nozzle 120 can be a detachable and removable component of the dirt container 110. In this case there are seals and latches (not shown) for coupling the detachable nozzle.

The vacuum cleaner 100 inherently has a directionality. There term "forward" refers to the nozzle 120 end of the vacuum cleaner. The term "rearward" refers to the back end of the vacuum cleaner where the motor fan assembly 500 is housed in the housing 102. The rearward end of the vacuum cleaner 100 is opposite the forward end of the vacuum cleaner. The term "top" refers to the upper side of vacuum cleaner where the first handle 104 is mounted. When the user grips the first handle 104, the vacuum cleaner 100 will naturally hang below the first handle 104.

The nozzle 120 comprises a second handle 124. The second handle 124 is a gripping portion of the projecting nozzle which is suitable for the user to wrap their fingers around. The diameter and cross section of the nozzle 120 is shaped so that a user's hand can wrap entirely or substantially around the nozzle 120. This means that the user can comfortably and securely grasp the nozzle 120 and the detachable dirt container 110.

Going back to FIG. 2, the detachable dirt container 110 will now be discussed in more detail. The detachable dirt container 110 is configured to be mountable on the housing 102. The detachable dirt container 110 comprises an exterior portion 204 which is exposed to the external environment when the detachable dirt container 110 is mounted on the housing 102. A portion of the dirt container 110 is an interior portion 206 which is inside the housing 102 and not exposed to the external environment when the dirt container 110 is mounted on the housing 102.

The internal portion 206 comprises an internal top portion 208. The internal top portion 208 is the portion of the dirt container 110 that is immediately adjacent the housing 102 when the dirt container 110 is mounted on the housing 102. An emptying aperture 210 is located in the internal top portion 208 of the dirt container 110. The emptying aperture 210 exposes the inside of the dirt container 110 to the external environment when the dirt container 110 is separated from the housing 102. The emptying aperture 210 allows dirt and debris which has been collected by the vacuum cleaner to be removed from the dirt container 110.

A peripheral lip 212 of the emptying aperture comprises a peripheral seal 214 for sealing against an interior surface of the housing 102. The peripheral seal 214 is engageable with the overlap portion 128. In some embodiments the seal 214 is a resiliently deformable material. In some embodiments the peripheral seal 214 a rubber material. Alternatively the seal is integral with the dirt container 110 and is a projecting member. In some embodiments, no additional seal element is required because engaging surfaces of the dirt container 110 and the housing 102 provide a suitably sufficient seal. For example the negative pressure created by the motor fan assembly 500 will suck the dirt container 110 against the housing 102.

The internal top portion 208 has an inherent directionality because the top portion 208 will face up away from the floor when detached from the housing 102. The internal top portion 208 is overlaid by an overlap portion 128 of the housing 102. The overlap portion 128 is best seen from FIGS. 1 and 3. The overlap portion 128 is integral with the housing 102. The overlap portion 128 projects forwardly from the housing 102 towards the nozzle 120.

By placing the emptying aperture 210 on the internal top portion 208, the user will detach the dirt container 110 with the emptying aperture 210 facing upwards. This means that the user will not spill the dirt from the dirt container on the floor when first removing the dirt container 110 from the housing 102.

Figure 3:
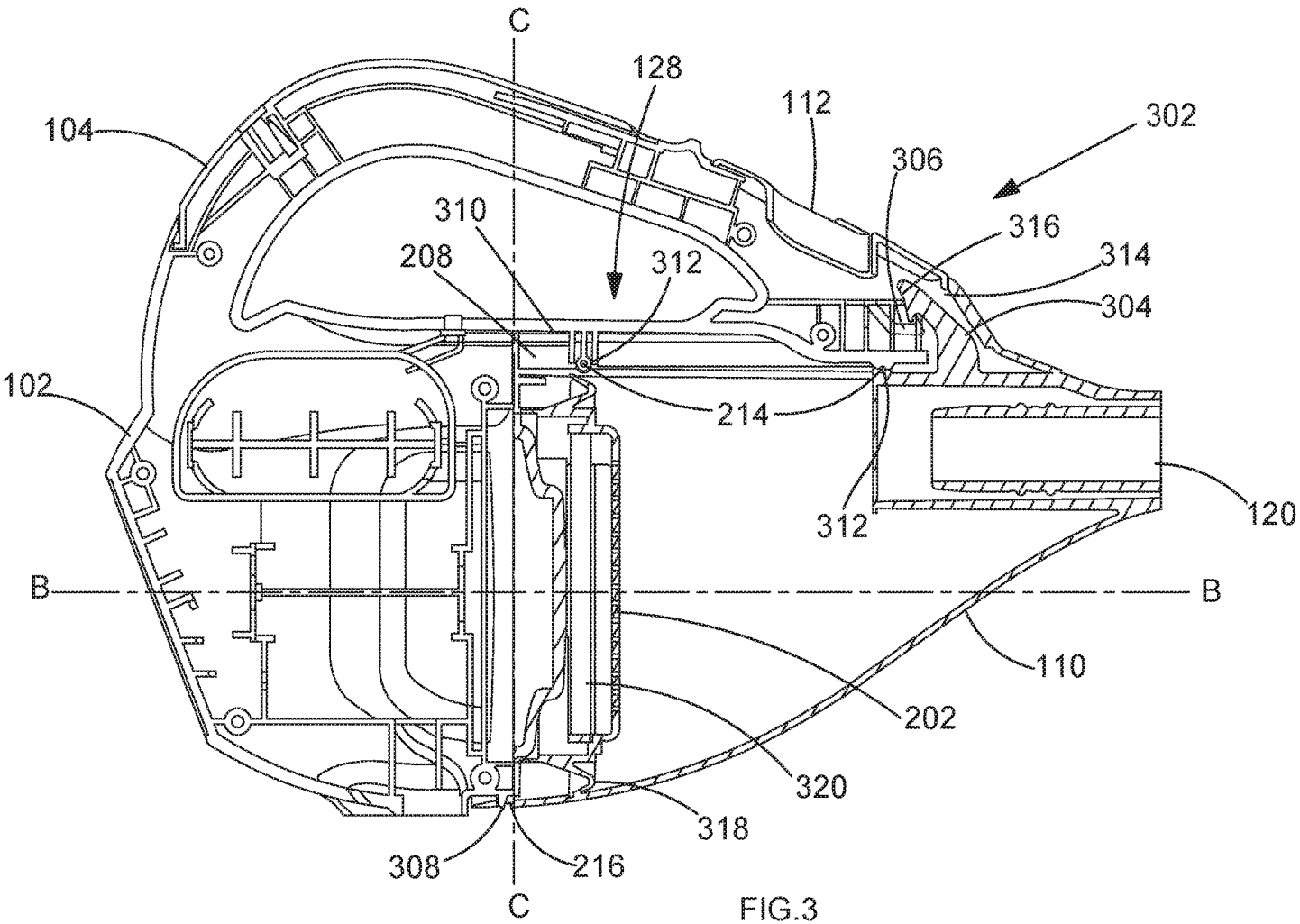
FIG. 3 shows a side cross sectional view of the vacuum cleaner along the axis A-A.
Figure 4:
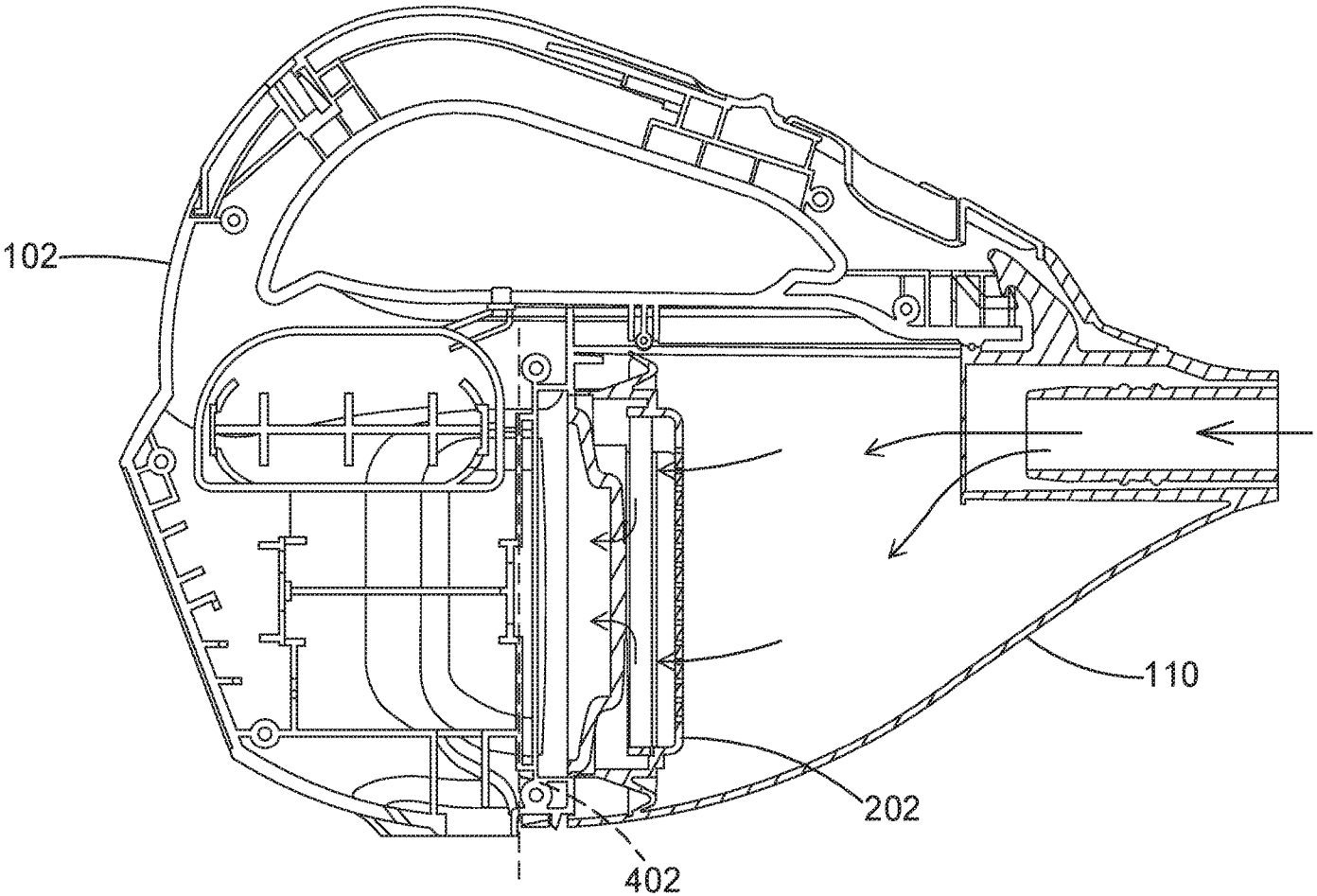
FIG. 4 is the same as FIG. 3 and shows the air flow path.

The mounting of the detachable dirt container 110 will now be discussed in reference to FIGS. 3 and 4. FIG. 3 shows a side cross section of the vacuum cleaner along the axis A-A (shown in FIG. 1). FIG. 3 shows the detachable dirt container 110 mounted on the housing 102. The nozzle 120 is partially shown and the dirty air inlet 122 is not shown in FIG. 3. FIG. 4 shows a forward cross section of the vacuum cleaner along the axis B-B (as shown in FIG. 1)

The overlap portion 128 is also shown in FIG. 3. The overlap portion 128 extends forward and overlaps the dirt container 110. As can be seen from FIG. 3, the first handle 104 is coupled to the overlap portion 128.

When the dirt container 110 is mounted on the housing 102, the interior top portion 208 is adjacent to the interior surface 310 of the overlap portion 128. The peripheral seal 214 is received in a reciprocal recess 312. The reciprocal recess 312 is the same shape as the peripheral lip 212 of the emptying aperture 210. When the peripheral seal 214 is seated in the reciprocal recess, the dirt container 110 is sealed against the housing 102. This means that there is no air flow path from the external environment to the dirt container 110 through the emptying aperture 210.

In some embodiments the dirt container 110 comprises the reciprocal recess 312 and the housing 102 comprises the seal 214.

The latching mechanism 302 and operation will now be described in further detail. The latch mechanism 302 is optional. For example in other embodiments the dirt container 110 is mounted on the housing 102 with other solutions such as resilient clips or a friction fit. In the embodiment shown in the Figures, the dirt container 110 is selectively releasable from the housing 102 with the latch mechanism 302. The latch mechanism 302 comprises a first portion 304 and a second reciprocal portion 306. The first portion 304 is a resilient hook portion 304 and the second portion 306 is a moveably biased latch portion 306. FIG. 3 show the latch mechanism 302 in a locked position whereby the dirt container 110 is fixed to the hosing 102. The latch portion 306 moves between a release position and a locked position. In the release position the latch portion 306 moves away clear from the hook portion 304. This means that the hook portion 304 is free to move out of the hole 314. The latch portion 306 is biased to the locked position. The latch portion 306 is biased with a spring or any other suitable biasing means.

The latch mechanism 302 is actuated by the latch release button 112. The latch release button is mechanically coupled to the latch portion 306. In some embodiments the latch portion is integral with the latch release button 112. The hook portion 304 comprises a cam surface 316. When the dirt container is coupled together with the hosing 102 and the hook portion 304 is inserted into the hole 314, the cam surface 316 pushes the latch portion 306 away from the locked position. The latch portion 306 snaps back into the locked position when the cam surface 316 moves past the latch portion 306. This locks the hook portion 304 and the dirt container 110 in place.

As mentioned above, the latch release button 112 is mounted on a forward portion 114 of the first handle 104. This means that the user is able to actuate the latch mechanism with their thumb when they are gripping the first handle 104. The latch release button 112 is mounted forward of the normal grip position of the first handle 104. This means that the user must positively move their thumb and press the button 112 in order to release the dirt container 110. This means that the dirt container being accidentally released is less likely.

In order to locate and seat the dirt container 110 accurately in the housing 102, the dirt container 110 optionally comprises a guide hole 216 on the underside of the dirt container 110. The guide hole 216 is on the side of the dirt container 110 opposite to the latch mechanism 302. The guide hole 216 engages with a protruding tongue 308. The protruding tongue 308 is integral with the housing 102. Once the guide hole 216 engages with the protruding tongue 308, the dirt container 110 pivots about the protruding tongue. The projecting side lips 116, 118 also guide the dirt container 110 around the housing 102 as the dirt container 110 pivots. This means that the hook portion 304 is aligned with the hole when the dirt container 110 is mounted to the housing. This reduces the chances of the dirt container 110 being misaligned by the user.

The filter 202 will now be discussed in further detail. The filter 202 comprises a pleated filter material 320 for separating the dirt and debris form the dirty airflow. As shown in FIG. 2, the filter 202 extends across the entire side of the dirt container 110 opposite the dirty are inlet 122. In this way the filter 202 fills the entire cross section of the dirt container 110 at a rearward end of the dirt container 110. The filter 202 comprises a filter sealing edge 318. The filter sealing edge 318 comprises a resiliently flexible portion of material that is compressed when mounted in the dirt container 110. The filter sealing edge 318 is urged against the inside surface of the dirt container 110 and seals there against. This means that when the filter 202 is mounted in the dirt container 110, the air flow only passes through the pleated filter material 320.

In some embodiments the filter 202 is wedged into the dirt container 110 using a friction fit. In other embodiments, the filter 202 is mounted using other means such as glue, or ribs which slot into rails or any other suitable mounting means. In some embodiments the filter 202 is removable and replaceable. This means that if the dirt container 110 needs a deep clean, the user can remove the filter 202 after removing the dirt container 110. This means that the user can gain access to the interior of the dirt container 110 when the filter 202 is removed. This means for example the user can run the dirt container 110 under the tap and/or clean the filter separately.

The emptying operation of the vacuum cleaner 100 will now be described. The user grips the first handle 104 with their first hand. The user then grips the second handle 124 on the nozzle 120 with their second hand. This means that the user is gripping both parts of the vacuum cleaner and they will not drop them when the housing 102 separates from the dirt container 110. The user then extends their thumb and presses the latch release button 112. The latch mechanism 302 is then moved into the release position and the hook portion 304 and the dirt container 110 are moveable with respect to the housing 102. The housing 102 and overlap portion 128 are then lifted away from the dirt container 110 as the housing 102 pivots about the guide hole 216. Once the dirt container 110 is separated from the housing 102, the emptying aperture 210 is revealed. The first and second handles 104, 124 naturally mean that the user will always open the vacuum cleaner 100 with the emptying aperture 210 facing upwards.

The user can then move the dirt container 110 to a dustbin and rotate it such that the emptying aperture faces downwards. In this position the dirt and debris in the dirt container will fall out of the emptying aperture 210. The user can tap the dirt container against the dustbin to dislodge the dirt if necessary.

This means that the dirt bypasses the filter when emptying the dirt container. The use does not have to touch the filter or the soiled parts of the dirt container during a normal emptying action. This means that the user does not get dirt on their hands because the user only touches clean parts of the vacuum cleaner during the emptying action.

Figure 5:
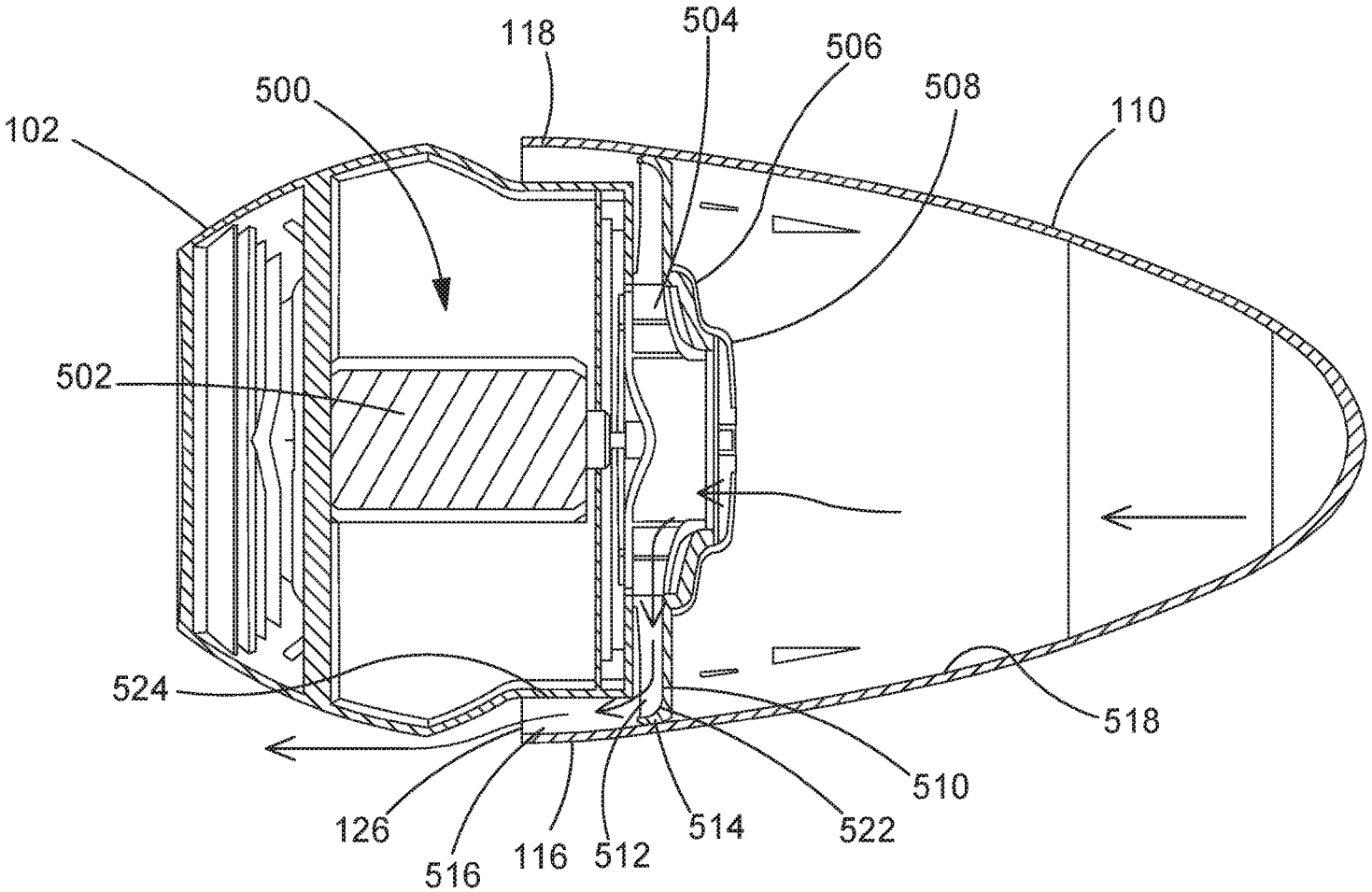
FIG. 5 shows a plan cross sectional view of the vacuum cleaner along the axis B-B.
Figure 6:
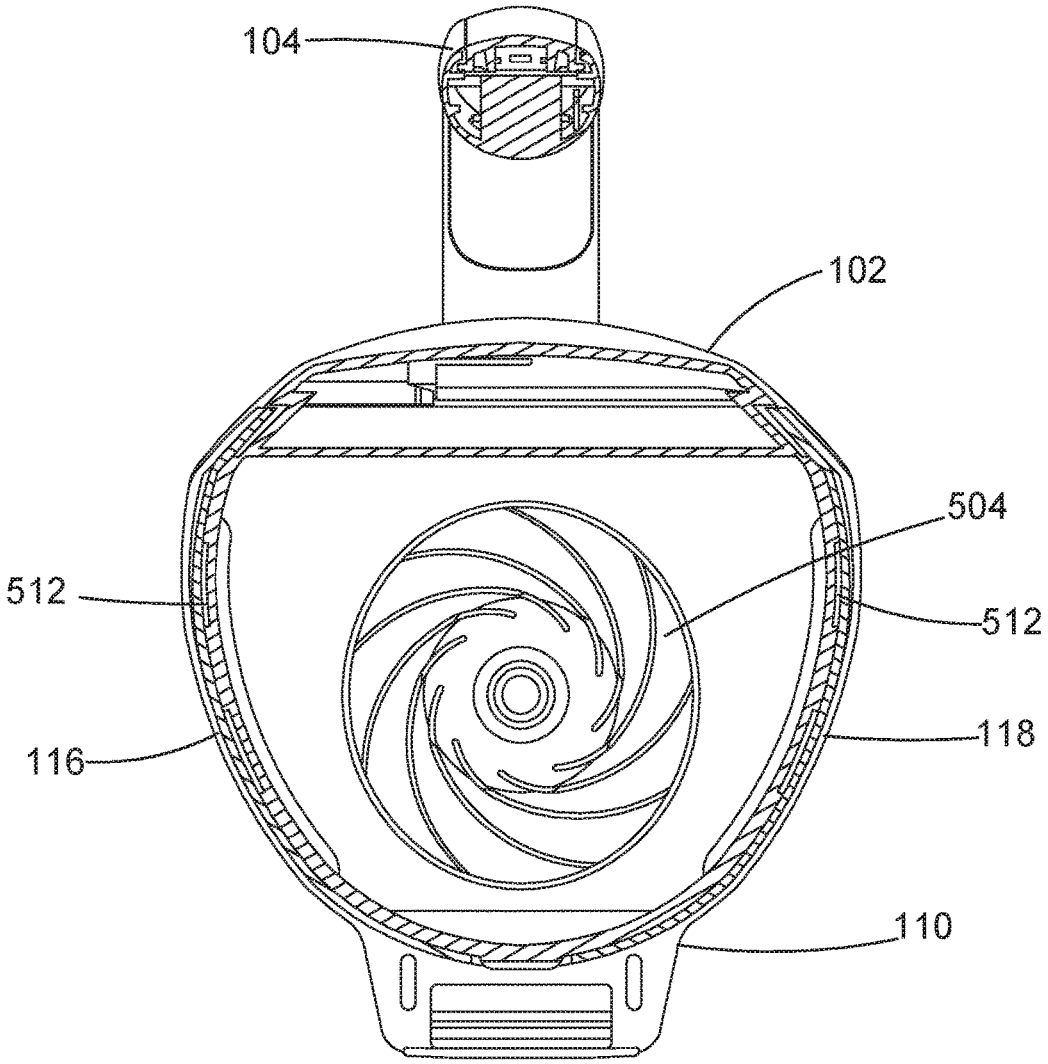
FIG. 6 shows a front cross sectional view of the vacuum cleaner along the axis C-C.

Operation of the vacuum cleaner 100 will now be discuss in further detail with reference to FIGS. 4, 5 and 6. FIG. 5 is a plan cross section along the line B-B and FIG. 6 is a forwards cross section along the line C-C. FIG. 4 is the same as FIG. 3 with arrows to represent the air flow.

During operation of the vacuum cleaner 100, the motor fan assembly 500 creates a negative pressure and sucks an air flow through the nozzle 120 and the dirt container 110. The dirt is separated from the air flow when the air flow passes through the filter 202. The direction of the airflow can be seen in FIG. 4 whereby the air flow is represented by arrows. The dirty air is incident on the filter 202. This causes the dirt and debris entrained in the air flow to be separated from the air flow because whilst the filter 202 is air permeable, the filter 202 does not have holes large enough to allow dirt to pass there through.

Once the air flows through the filter 202, the fan 504 exhausts via the clean air outlets 512. FIG. 4 is a cross sectional diagram and does not show the air outlets but the air outlets are shown in FIG. 5. The extent of the overlap of the first and second projecting side lips 116, 118 with respect to the housing 102 is shown by a dotted line 402. The dotted line 402 represents the peripheral edge of the first and second projecting side lips 116, 118.

The exhaust air flow path will now be described with respect to FIGS. 5 and 6. FIG. 5 shows the motor fan assembly 500 comprising the motor 502 and the fan 504. As mentioned above the filter 202 is not shown in FIG. 5. The motor fan assembly 500 is housed within the housing 102. The fan 504 is housed at a front portion 506 of the housing 102, which faces the nozzle end of the vacuum cleaner. The front portion 506 comprises a grill on the surface 508 which is immediately adjacent to the filter 202 when the dirt container 110 is mounted on the housing 102.

The clean air is sucked in through the grill on the surface 508 by virtue of the fan 504. The clean air is incident on the fan 504 at substantially the centre of the fan 504. The clean air is then driven radially away from the fan 504 through an exhaust conduit 510. In this way the air flow is directed towards the side walls of the housing 102. By directing the air flow from the fan 504 to the side walls of the housing 102, the air flow takes the most direct route from the fan 504 to the external environment. This means that less energy is required to exhaust the clean air from the vacuum cleaner. In some embodiments the first and second projecting lips 116, 118 overlap the housing 102 and project past the location of the fan 504 in the housing. This means that the first and second projecting lips 116, 118 will overlap the air outlet 512 if the exhaust conduit 510 takes the shortest path from the fan 504 to the exterior of the housing 102.

Exhaust conduit 510 is formed from the internal structure of the housing 102 and guides the clean air from the fan 504 to an air outlet 512. For the purposes of clarity only one air outlet 512 is shown and referenced in FIG. 5. In some embodiments there are a plurality of air outlets 512. In one embodiment there is a first air outlet 512 located near the first side projecting lip 116 and a second air outlet 512 located near the second side projecting lip 118. In other embodiments there are a plurality of air outlets 512 located near each of the projecting lips 116, 118.

Exhaust conduit 510 can be formed integrally with the housing 102 or additionally or alternatively additional internal walls or pipes can be attached to the housing 102 to define the exhaust conduit 510. The air outlet 512 is an opening in the housing 102 where the clean air is outputted from the housing 102. When the dirt container 110 is not attached to the housing 102, the air outlet 512 is visible and exposed to the external environment.

When the dirt container 110 is mounted on the housing 102, the first and second projecting side lips 116, 118 overlap and extend past the air outlets 512. A side baffle portion 514 of the front portion 506 of the housing 102 extends to the inner surface 518 of the dirt container 110. The side baffle portion forms a seal or a partial seal with the inner surface 518 of the dirt container 110. The side baffle portion 514 directs the air flow rearwards and limits or prevents the air flow moving towards the nozzle and the filter 202. The side baffle portion 514 is optional because the downstream (clean) side of the filter 202 (not shown in FIG. 5) can also perform this function.

In some embodiments the exhaust conduit 510 comprises a curved deflecting wall 522 immediately adjacent to the air outlet 512. The curved deflecting wall 522 helps gradually change the direction of the air flow without causing excessive turbulence. In some embodiments the air outlet 512 is angled rearwards. The air outlet 512 can be directed rearwards by locating the air outlet 512 in a rearward facing surface or an angled surface of the housing 102 which partially directs rearwards. By directing the air outlet 512 at least partially rearwards, the air flow will have a rearwards directional component and the air flow is easier to fully direct rearwards. This means that the redirection of the air flow is gradual and flow of the exhaust air is easier and more efficient from the housing. A rearward facing outlet 512 and a curved deflecting wall 522 are optional that the entire air flow can be redirected by the shape of the inner surface 518 of the first and second side projecting lips 116, 118.

The first and second projecting lips 116, 118 are not flush against the housing 102. Indeed the projecting lips 116, 118 define a side conduit 516 between the inner surface 518 of the dirt container 110 and the outer surface 524 of the housing. The side conduit 126 is in fluid communication with the air outlet 512 and terminates in the side vent 126.

The clean air is then exhaust through side vents 126. The side conduits 516 guide the exhaust clean air rearward in a direction away from the nozzle 120 and generally from the vacuum cleaner 100. By directing the clean air rearwards away from the nozzle 120, the clean air is less likely to blow the dirt and debris away from the nozzle 120.

As mentioned above the first and second projecting lips 116, 118 and air outlets 512 are on the sides of the vacuum cleaner 100. By locating these features on the first and second sides, the exhaust air is not directed downwards towards the surface being cleaned. This means that the exhaust air is also less likely to blow dirt and debris away from the nozzle 120. In some embodiments the first and second projecting lips 116, 118 and the air outlets 512 are located on other parts of the vacuum cleaner. For example additionally or alternatively a projecting lip (not shown) is located on the base of the vacuum cleaner 100. The projecting lip on the base defines a base vent with the housing 102. Even though the base vent is close to the surface to be cleaned, the projecting lip directs the air flow away from the nozzle 120.

In other embodiments the filter can be other types of dirt separation means. For example the filter can be a pleated conical filter or a cyclonic separation apparatus.

In another embodiment two or more embodiments are combined. Features of one embodiment can be combined with features of other embodiments.

Embodiments of the present invention have been discussed with particular reference to the examples illustrated. However it will be appreciated that variations and modifications may be made to the examples described within the scope of the invention.

The invention claimed is:

1. A vacuum cleaner comprising:

a housing;

a motor fan assembly arranged to generate an air flow;

a detachable dirt container mountable to the housing; the dirt container having a dirty air inlet in fluid communication with the motor fan assembly;

a filter for separating dirt from the air flow, the filter being mounted between the dirt container and the motor fan assembly; and the housing comprises at least one air outlet for exhausting clean air from the motor fan assembly;

wherein the detachable dirt container comprises at least one projecting lip arranged to overlap the at least one air outlet when the detachable dirt container is mounted on the housing and direct the air flow away from the dirty air inlet.

2. A vacuum cleaner according to claim 1 wherein the at least one air outlet is a first air outlet on a first side of the housing and a second air outlet on a second side of the housing.

3. A vacuum cleaner according to claim 1 wherein the housing and the at least one projecting lip are arranged to define at least one air exhaust conduit when the detachable dirt container is mounted on the housing.

4. A vacuum cleaner according to claims 1 wherein the air flow is directed along the surface of the housing in a direction opposite to the dirty air inlet.

5. A vacuum cleaner according to claim 1 wherein the at least one projecting lip comprises a first projecting lip and a second projecting lip arranged to respectively extend substantially along the first and second sides of the housing.

6. A vacuum cleaner according to claim 5 wherein the first and second projecting lips extend rearwards beyond the fan when the dirt container is mounted on the housing.

7. A vacuum cleaner according to claim 2 wherein a portion of the housing adjacent to the first and second air outlets is engageable with the detachable dirt container.

8. A vacuum cleaner according to claim 1 wherein the vacuum cleaner comprises a latch mechanism for selectively releasing the dirt container from the housing.

9. A vacuum cleaner according to claim 8 wherein the latch mechanism comprises a first portion of the latch mechanism on the housing and a second reciprocal portion of the latch mechanism on the dirt container.

10. A vacuum cleaner according to claims 8 wherein the latch mechanism comprises a latch release button mounted in the housing for actuating the latch mechanism.

11. A vacuum cleaner according to claim 10 wherein the latch release button is mounted in a first handle and actuatable with a user's thumb.

12. A vacuum cleaner according to claim 1 wherein the filter is removable from the dirt container.

13. A vacuum cleaner according to claim 1 wherein the filter is mountable on the dirt container and sealable against the dirt container.

14. A vacuum cleaner according to claim 13 wherein the filter is a wall of the dirt container.

15. A vacuum cleaner according to claim 1 wherein the vacuum cleaner is a handheld vacuum cleaner.

* * * * *